US010119174B2

(12) United States Patent
Nakano

(10) Patent No.: US 10,119,174 B2
(45) **Date of Patent: *Nov. 6, 2018**

(54) HOT WORK TOOL MATERIAL AND METHOD FOR MANUFACTURING HOT WORK TOOL

(71) Applicant: HITACHI METALS, LTD., Tokyo (JP)

(72) Inventor: Yousuke Nakano, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 142 days.

This patent is subject to a terminal disclaimer.

(21) Appl. No.: 15/114,604

(22) PCT Filed: May 26, 2015

(86) PCT No.: PCT/JP2015/065043
§ 371 (c)(1),
(2) Date: Jul. 27, 2016

(87) PCT Pub. No.: WO2015/182586
PCT Pub. Date: Dec. 3, 2015

(65) Prior Publication Data

US 2016/0348202 A1 Dec. 1, 2016

(30) Foreign Application Priority Data

May 28, 2014 (JP) ..... 2014-110036

(51) Int. Cl.
*C21D 6/00* (2006.01)
*C22C 38/24* (2006.01)
(Continued)

(52) U.S. Cl.
CPC ..... *C21D 9/0068* (2013.01); *C21D 1/18* (2013.01); *C21D 1/25* (2013.01); *C21D 6/002* (2013.01);
(Continued)

(58) Field of Classification Search
None
See application file for complete search history.

(56) References Cited

U.S. PATENT DOCUMENTS

2002/0040744 A1* 4/2002 Kanisawa ..... C21D 8/06 148/320
2009/0188589 A1* 7/2009 Okitsu ..... C21D 6/005 148/504
2015/0041029 A1* 2/2015 Yamashita ..... C21D 8/06 148/645

FOREIGN PATENT DOCUMENTS

CN 103352108 A 10/2013
CN 103403209 A 11/2013
(Continued)

OTHER PUBLICATIONS

Translation of JP 09-316595 (published Dec. 9, 1997) from J-Plat Pat.*
(Continued)

*Primary Examiner* — George Wyszomierski
(74) *Attorney, Agent, or Firm* — Sughrue Mion, PLLC

(57) ABSTRACT

Provided are a hot work tool material having an annealed structure effective for producing a finer quenched and tempered structure when made into a hot work tool, and a method for manufacturing a hot work tool. A hot work tool material which has an annealed structure and which is used upon being quenched and tempered, wherein the hot work tool material has a composition that can be adjusted to a martensite structure by the aforementioned quenching, and ferrite grains in a cross-section of the annealed structure of
(Continued)

the hot work tool material have, in an oversize cumulative distribution based on the cross-sectional area of the ferrite grains, a grain diameter distribution such that the grain diameter is 25 μm or less as a circle equivalent diameter when the cumulative cross-sectional area is 90% of the total cross-sectional area. In addition, a method for manufacturing a hot work tool in which quenching and tempering is performed on the aforementioned hot work tool material.

3 Claims, 3 Drawing Sheets

(51) Int. Cl.

| | |
|---|---|
| ***C21D 9/00*** | (2006.01) |
| ***C21D 1/18*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C21D 7/13*** | (2006.01) |
| ***C21D 1/25*** | (2006.01) |

(52) U.S. Cl.

CPC ..... *C21D 6/005* (2013.01); *C21D 6/008* (2013.01); *C21D 7/13* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C21D 2211/001* (2013.01)

(56) References Cited

FOREIGN PATENT DOCUMENTS

| | | | |
|---|---|---|---|
| EP | 2682491 | A1 | 1/2014 |
| JP | 2-179848 | A | 7/1990 |
| JP | 9-316595 | A | 12/1997 |
| JP | 11-36044 | A | 2/1999 |
| JP | 2000-42606 | A | 2/2000 |
| JP | 2000-328196 | A | 11/2000 |
| JP | 2002-248508 | A | 9/2002 |
| JP | 2007-56289 | A | 3/2007 |
| JP | 2009-215656 | A | 9/2009 |
| WO | 2008/032816 | A1 | 3/2008 |

OTHER PUBLICATIONS

Translation of JP 11-036044 (published Feb. 9, 1999) from J-Plat Pat.*

Translation of JP 2000-042606 (published Feb. 15, 2000) from J-Plat Pat.*

International Search Report for PCT/JP2015/065043 dated Aug. 18, 2015.

* cited by examiner (a) OPTICAL MICROSCOPE IMAGE (b) CRYSTAL GRAIN BOUNDARY VIEW (a) OPTICAL MICROSCOPE IMAGE (b) CRYSTAL GRAIN BOUNDARY VIEW (a) OPTICAL MICROSCOPE IMAGE (b) CRYSTAL GRAIN BOUNDARY VIEW (a) OPTICAL MICROSCOPE IMAGE (b) CRYSTAL GRAIN BOUNDARY VIEW

HOT WORK TOOL MATERIAL AND METHOD FOR MANUFACTURING HOT WORK TOOL

TECHNICAL FIELD

The present invention relates to a hot work tool material suitable for various hot work tools such as a press die, a forging die, a die-casting die, and an extrusion tool, and to a method for manufacturing a hot work tool from the material.

BACKGROUND ART

Hot work tools are required to have a toughness such that they are resistant to impacts, since they are used in contact with high-temperature and hard workpieces. Conventionally, alloy tool steels, such as SKD61 which is a JIS steel grade, have been used for the hot work tool materials. Recently, further improved toughness has been required and thus alloy tool steels having modified composition of the SKD61 alloy tool steel have been proposed (see Patent Literatures 1 to 3).

Typically, hot work tool materials in an annealed state, which have a low hardness, are supplied to hot work tools manufacturers. The supplied materials are machined into shapes of the hot work tools and then quenched and tempered to have a specific hardness for use. After the adjustment of the hardness, they are typically subjected to finish machining. In some cases, the materials in the annealed state are quenched and tempered first, and then machined into the shapes of hot work tools together with the finish machining. The quenching is defined as an operation of heating a hot work tool material in an annealed state (or the hot work tool material after machined) to a temperature in an austenite region and then rapidly cooling it to cause a martensitic transformation. Therefore, a composition of the hot work tool material is adjusted such that the material can have the martensite structure by quenching.

It has been known that a toughness of the hot work tool can be improved when the hot work tool has a finer structure after the martensitic transformation. Specifically, it means that prior austenite grain size in the structure of the hot work tool is made fine. As a method for reducing the prior austenite grain size, it is effective to adjust a structure of the annealed hot work tool material before quenching. For example, it is proposed to make the structure "a mixed structure including, as observed at a magnification of 10,000, a region A of high carbide density where a number of carbides with 0.1 to 0.5 μm circle-equivalent diameter per 100 $\mu m^2$ is 300 or more and a region B of low carbide density where a number of carbides with 0.1 μm to 0.5 μm circle-equivalent diameter is smaller 100 or more than that in the region A" (Patent Literature 4).

CITATION LIST

Patent Literature

Patent Literature 1: JP-A-2-179848
Patent Literature 2: JP-A-2000-328196
Patent Literature 3: WO 2008/032816
Patent Literature 4: JP-A-2007-056289

SUMMARY OF INVENTION

Technical Problem

Patent Literature 4 provides an effective technique for producing a fine structure of a hot work tool. When the hot work tool material of Patent Literature 4 is quenched, the Prior austenite grain size can be reduced to a grain size number of No. 9.0 (average grain size of about 18 μm) pursuant to JIS-G-0551 (ASTM-E112) (note that the grain size becomes smaller as the grain size number is greater). However, it is required, before the quenching, to adjust the metal structure to an annealed structure having a complex carbide distribution for achieving the grain refinement.

It is an objective of the present invention to provide a hot work tool material having an annealed structure which is effective for producing a fine structure when the material is made into a hot work tool, by adjusting a factor other than carbide distribution in the annealed structure. It is also an objective of the invention to provide a method for manufacturing the hot work tool.

Solution to Problem

The present invention provides a hot work tool material used after quenched and tempered and has an annealed structure. The material has a composition adjusted such that the material has a martensite structure. Ferrite grains in the annealed structure in a cross-sectional structure have, in an oversize cumulative distribution based on a cross-sectional area of the ferrite grains, a grain diameter distribution such that the grain diameter is not greater than 25 μm as a circle equivalent diameter when the cumulative cross-sectional area is 90% of the total cross-sectional area.

The present invention also provides a method for manufacturing a hot work tool. The method includes quenching and tempering the above hot work tool material of the present invention. Preferably, the method includes quenching and tempering the above hot work tool material of the present invention such that a prior austenite grain size in a structure of the hot work tool after the quenching and tempering is not less than No. 9 as a grain size number pursuant to JIS-G-0551.

Advantageous Effect of Invention

According to the present invention, the prior austenite grain size observed in the structure of the hot work tool can be made fine.

DESCRIPTION OF EMBODIMENTS

Figure 1:
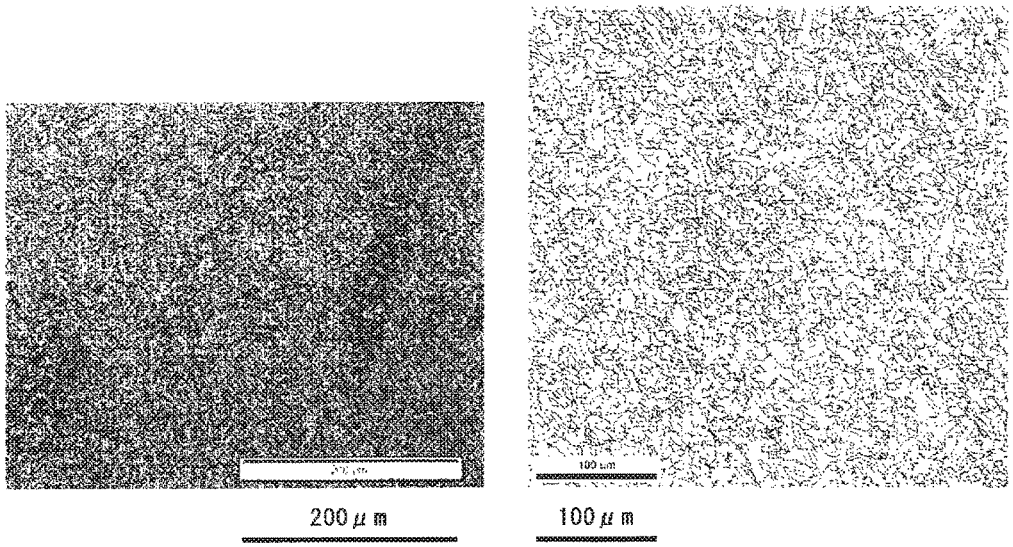
FIG. 1 shows (*a*) an optical microscope image of a sectional structure and (*b*) a grain boundary view obtained by electron backscatter diffraction (hereinafter, referred to as "EBSD") of a hot work tool material "A" as an example of the invention.

The present inventor has investigated factors in an annealed structure of a hot work tool material, which have effects on a prior austenite grain size of a quenched and tempered structure. As a result, the inventor has found that the factors include a distribution of ferrite grains as well as a distribution of carbides in the annealed structure. The inventor has found that the prior austenite grain size in the quenched and tempered structure can be made fine by producing the ferrite grains having a specific grain diameter distribution in the annealed structure, and thus reached the present invention. Hereinafter, each component of the present invention will be described.

(1) A hot work tool material used after quenched and tempered, having an annealed structure and having a composition such that the material has a martensitic structure after quenched:

The "annealed structure" is defined as a structure obtained by an annealing process, and is preferably a softened structure having a hardness of e.g. about 150 to 230 HBW in Brinell hardness. Typically, the structure is composed of a ferrite phase, or composed of the ferrite phase with perlite or cementite ($Fe_3C$). The ferrite phase constitutes the "ferrite grains" in the annealed structure. In a case of the hot work tool material such as an alloy tool steel SKD61, carbides of Cr, Mo, W or V etc. may precipitate within the ferrite grains or at grain boundaries. In the present invention, the annealed structure preferably includes less perlite or cementite. The perlite or cementite may reduce machinability of the hot work tool material not a little.

Accordingly, in a preferable annealed structure of the hot work tool material of the present invention, for example not less than 80 area % of the sectional structure is preferably observed as ferrite grains. Not less than 90 area % is more preferable. In this regard, the carbides of Cr, Mo, W or V etc. within the ferrite grains or at the grain boundaries have less influence on the machinability than perlite, cementite, or the like, and thus they are included in the area of the ferrite grains.

The hot work tool material having an annealed structure is typically produced from a starting material of a steel ingot or a billet bloomed from the ingot. The starting material is subjected to various hot working or heat treatment followed by annealing, and finished into a block shape. As stated above, a raw material which transforms into a martensite structure by quenching and tempering is conventionally used for a hot work tool material. The martensite structure is necessary for an absolute toughness of various hot work tools. Typical examples of the raw material include various hot work tool steels. The hot work tool steels are used in an environment where a surface temperature of the steels is raised at not lower than about 200° C. Typical compositions of the hot work tool steels include those of standard steel grades in JIS-G-4404 "alloy tool steels" and other proposed materials. In addition, elements that are not defined in the hot work tool steels can be added as needed.

The refining effect of the structure of the hot work tool of the present invention can be achieved as far as the annealed structure of the raw material transforms into a martensite structure when quenched and tempered, and the annealed structure satisfies requirement (2) which will be explained later. Accordingly, there is no need to specify a composition of the raw material for achieving the refining effect of the structure of the hot work tool of the present invention.

However, for basing the absolute mechanical properties for the hot work tool, the material preferably has a composition of the hot work tool steel including 0.30% to 0.50% of C and 3.00% to 6.00% of Cr by mass, as a composition having a martensite structure. Furthermore, for improving an absolute toughness of the hot work tool, it is preferable that the hot work tool steel including 0.10% to 1.50% of V. As an example, the material preferably has a composition including 0.30% to 0.50% of C, not greater than 2.00% of Si, not greater than 1.50% of Mn, not greater than 0.0500% of P, not greater than 0.0500% of S, 3.00% to 6.00% of Cr, 0.50% to 3.50% of one or both of Mo and W in an expression of (Mo+½ W), 0.10% to 1.50% of V, and the balance of Fe and impurities.

C: 0.30% to 0.50% by Mass (Hereinafter, Simply Expressed as "%")

Carbon is a basic element of the hot work tool material. A part of carbon solid-dissolves in a matrix to strengthen it, and a part of carbon forms carbides to enhance an abrasion resistance and a seizure resistance. Furthermore, when carbon is added together with a substitutional atom having high affinity to carbon, such as Cr, the carbon solid-dissolved as an interstitial atom has an I (interstitial atom)-S(substitutional atom) effect (which highly strengthens the hot work tool by acting as a drag resistance of the solute atom). However, excessive addition of carbon reduces toughness or hot strength. Therefore, the content is preferably 0.30% to 0.50%. It is more preferably not less than 0.34%. It is further more preferably not greater than 0.40%.

Si: Not Greater than 2.00%

Si is a deoxidizing agent for steel making. Excessive Si causes production of ferrite in the tool structure after quenching and tempering. Therefore, the Si content is preferably not greater than 2.00%. It is more preferably not greater than 1.00%. It is further more preferably not greater than 0.50%. On the other hand, Si has an effect of enhancing a machinability of materials. In order to obtain this effect, addition of not less than 0.20% is preferable. Not less than 0.30% is more preferable.

Mn: Not Greater than 1.50%

Excessive Mn increases a viscosity of a matrix and reduces a machinability of materials. Therefore, the content is preferably not greater than 1.50%. It is more preferably not greater than 1.00%. It is further more preferably not greater than 0.75%. On the other hand, Mn has effects of enhancing hardenability and suppressing a production of ferrite in the tool structure, thereby obtaining an appropriate quenched and tempered hardness. Furthermore, Mn produces a non-metallic inclusion MnS which has a significant effect in improving a machinability. In order to obtain these effects, addition of not less than 0.10% is preferable. Not less than 0.25% is more preferable and not less than 0.45% is further more preferable.

P: Not Greater than 0.0500%

Phosphor is an element that is inevitably included in various hot work tool materials even though it is not intentionally added. It segregates at prior austenite grain boundaries during heat treatment such as tempering, and embrittles the grain boundaries. Accordingly, the content is preferably limited to not greater than 0.0500%, including a cases where phosphor is added to improve a toughness of the hot work tool.

S: Not Greater than 0.0500%

Sulfur is an element that is inevitably included in various hot work tool materials even though it is not intentionally added. It deteriorates a hot workability of raw materials before hot worked and causes cracks in the raw materials during hot working. Accordingly, the content is preferably limited to not greater than 0.0500% in order to improve the hot workability. On the other hand, sulfur is combined with Mn to form a non-metallic inclusion MnS and has an effect of improving a machinability. In order to obtain this effect, addition of not less than 0.0300% is preferable.

Cr: 3.00% to 6.00%

Cr is a basic element of hot work tool materials. Cr has effects of enhancing a hardenability and forms a carbide which strengthens a matrix and improves an abrasion resistance and toughness. However, excessive addition reduces a hardenability and high-temperature strength. Therefore, the content is preferably 3.00% to 6.00%. Furthermore, it is more preferably not greater than 5.50%. It is further more preferably not greater than 5.00%. It is particularly preferably not greater than 4.50%. On the other hand, it is preferably not less than 3.50%. In the present invention, since an effect of improving a toughness can be obtained by refining the hot work tool structure, an amount of Cr can be reduced by the amount. In this case, the high-temperature strength of the hot work tool can be further improved, for example, by adjusting the Cr content to not greater than 5.00%, furthermore to not greater than 4.50%.

One or Both of Mo and W Represented by Relational Expression of (Mo+½ W): 0.50% to 3.50%

Mo and W can be added solely or in combination, in order to precipitate or aggregate fine carbides through tempering to improve strength and a resistance to softening. In this regard, the added amounts can be defined as an Mo equivalent represented by the relational expression of (Mo+½ W) since W has an atomic weight about twice that of Mo (of course, either one element may be added solely, or both elements can be added in combination). In order to obtain the effects, addition of not less than 0.50% of the value obtained by the relational expression of (Mo+½ W) is preferable. The amount is more preferably not less than 1.50%. It is further preferably not less than 2.00%. However, excessive Mo and W reduces a machinability and toughness, and therefore the content is preferably not greater than 3.50% of the value obtained by the relational expression of (Mo+½ W). It is more preferably not greater than 3.00%. It is further more preferably not greater than 2.50%.

V: 0.10% to 1.50%

Vanadium forms a carbide and has effects of strengthening a matrix and improving an abrasion resistance and a resistance to softening in tempering. Furthermore, the vanadium carbide distributed in the annealed structure functions as "pinning particle" which suppresses coarsening of austenite grains during heating for quenching, to contribute to improving toughness. In order to obtain the effects, addition of not less than 0.10% is preferable. In the present invention, it is preferable to add vanadium in order to further facilitate refinement of the hot work tool structure. The amount to be added is more preferably not less than 0.30%. It is further more preferably not less than 0.50%. However, excessive vanadium reduces a machinability and toughness due to an increase of carbides, and therefore the content is preferably not greater than 1.50%. It is more preferably not greater than 1.00%. It is further more preferably less than 0.80%.

Other than the above elementals, following elementals can be added.

Ni: 0% to 1.00%

Ni is an element that increases a viscosity of a matrix and reduces machinability. Therefore, a Ni content is preferably not greater than 1.00%. It is more preferably less than 0.50%, further more preferably less than 0.30%. On the other hand, Ni suppresses a production of a ferrite in the tool structure. Furthermore, Ni is effective for excellent hardenability together with C, Cr, Mn, Mo, W, etc., and thus prevents a reduction of a toughness by forming a structure mainly composed of martensite, even though a cooling rate in quenching is low. Furthermore, Ni also improves an essential toughness of a matrix, and therefore may be added as needed in the present invention. In the case of addition, addition of not less than 0.10% is preferable.

Co: 0% to 1.00%

Co reduces a toughness, and thus a Co content is preferably not greater than 1.00%. On the other hand, Co forms a protective oxide film which is dense and has good adhesion to a surface of the hot work tool during a high temperature in use of the tool. The oxide film prevents a metal contact with a mating member, and suppresses a temperature rise on a tool surface, thereby an excellent abrasion resistance is obtained. Therefore, Co may be added as needed. In the case of addition, addition of not less than 0.30% is preferable.

Nb: 0% to 0.30%

Nb reduces a machinability, and thus a Nb content is preferably not greater than 0.30%. On the other hand, Nb has effects of strengthening a matrix and improving an abrasion resistance by forming carbides. Furthermore, Nb has effects of enhancing a resistance to softening due to tempering, and suppressing a coarsening of grains to contribute to improving a toughness, in the same manner as vanadium. Therefore, Nb may be added as needed. In the case of addition, addition of not less than 0.01% is preferable.

Cu, Al, Ca, Mg, O (oxygen) and N (nitrogen) are elements that may possibly remain in a steel as inevitable impurities. Amounts of these elements are preferably as small as possible in the present invention. However, small amounts may be included in order to obtain additional actions and effects such as improvement of morphology control of inclusions, other mechanically properties, and production efficiency. In this regard, Cu≤0.25%, Al≤0.040%, Ca≤0.0100%, Mg≤0.0100%, O≤0.0100%, and N≤0.0300% are sufficiently acceptable, and they are preferable maximum limitations in the present invention. The amount of Al is more preferably not greater than 0.025%.

(2) In the hot work tool material of the present invention, ferrite grains in the annealed structure in a cross-sectional structure has, in an oversize cumulative distribution based on a cross-sectional area of the ferrite grains, a grain diameter distribution such that the grain diameter is not greater than 25 μm as a circle equivalent diameter when the cumulative cross-sectional area is 90% of the total cross-sectional area.

The inventor has reviewed a behavior of generation of a martensite structure from the annealed structure in a series of quenching steps of heating the hot work tool material having the annealed structure at a quenching temperature (austenite temperature range) and rapidly cooling it. First, in a heating process of the material toward the quenching temperature, "new austenite grains" start precipitating preferentially at grain boundaries of ferrite grains in the annealed structure from a time when the temperature has reached a point $A_1$. Next, in a process of holding the material at the quenching temperature for a time after the material has reached the temperature, the annealed structure is totally replaced substantially by the new austenite grains. Then, the material is cooled, thereby the metal structure undergoes martensitic transformation. Thus, a martensite structure is formed where the grain boundaries of the austenite grains are observed as "prior austenite grain boundaries", and thus the quenching is completed. A distribution of "the prior austenite grain size" (the grain diameter) which is formed by the prior austenite grain boundaries is substantially maintained even after the subsequent tempering step (that is, in the finished hot work tool).

Accordingly, in order to produce a finer structure of the hot work tool, or, in order to reduce the prior austenite grain size, new austenite grains which precipitate at the grain boundaries of the ferrite grains is kept fine in the quenching step. For this purpose, the new austenite grains are to be prevented from growing larger after the precipitation. As a result of studies, the inventor has found that the growth of the new austenite grains in the quenching step can be suppressed by making the ferrite grains in the annealed structure fine before the heating for quenching. That is, the grain boundary density of ferrite grains is increased by refining the ferrite grains in the annealed structure before the heating for quenching. When the grain boundary density of the ferrite grains is increased, the grain boundaries (precipitation sites) at which the austenite grains precipitate during the heating increase and become dense. This abundant and dense austenite grains, that have a sufficiently close distance from each other, suppress the growth each other. As a result, when the hot work tool material is cooled from the quenching temperature, the austenite grains are cooled as keeping fine grains, and therefore the prior austenite grain size after the quenching is kept fine, and thus a fine structure can be obtained.

The inventor has further studied on the refinement of the ferrite grains in the annealed structure of the hot work tool material. As a result, the inventor has found that the precipitation sites can be made sufficiently abundant and dense by reducing the diameter of the ferrite grains in the cross-section of the annealed structure to a grain diameter distribution of not greater than 25 μm as a circle equivalent diameter when the cumulative cross-sectional area is 90% of the total cross-sectional area, in an oversize cumulative distribution based on the cross-sectional area of the ferrite grains. The grain diameter distribution is preferably 20 μm or less. Furthermore, the inventor has ascertained that this enables a reduction of the of the prior austenite grain size after the quenching to a grain size number of No. 9.0, and furthermore to a grain size number beyond No. 9.0 such as No. 10.0 (average grain diameter of about 13 μm). The inventor has confirmed that the reduced diameter of the prior austenite grains is substantially maintained after the subsequent tempering.

Here, a measuring method of the "grain diameter distribution" used for the evaluation of the ferrite grain diameter in the present invention will be described. First, it is necessary to identify each ferrite grain out of a group of ferrite grains on the cross-section of the hot work tool material by microscopic observation of the sectional structure. Examples of the identification method include EBSD (electron backscatter diffraction analysis). The EBSD is a method for analyzing an orientation of a crystalline sample. Each ferrite grain in the sectional structure is identified as "a unit having the same orientation", that is, the grain boundary of the grain can be emphasized. As a result, each ferrite grain can be distinguished in the group of ferrite grains. FIG. 1 (*b*) is an example of the grain boundary view obtained by the EBSD of the sectional structure of a hot work tool material A evaluated in Example described below. FIG. 1 (*b*) shows high-angle grain boundaries with an orientation difference of 15° or more by analyzing the diffraction pattern of the EBSD. In FIG. 1 (*b*), each of multiple sections defined by fine lines is a ferrite grain.

Figure 3:
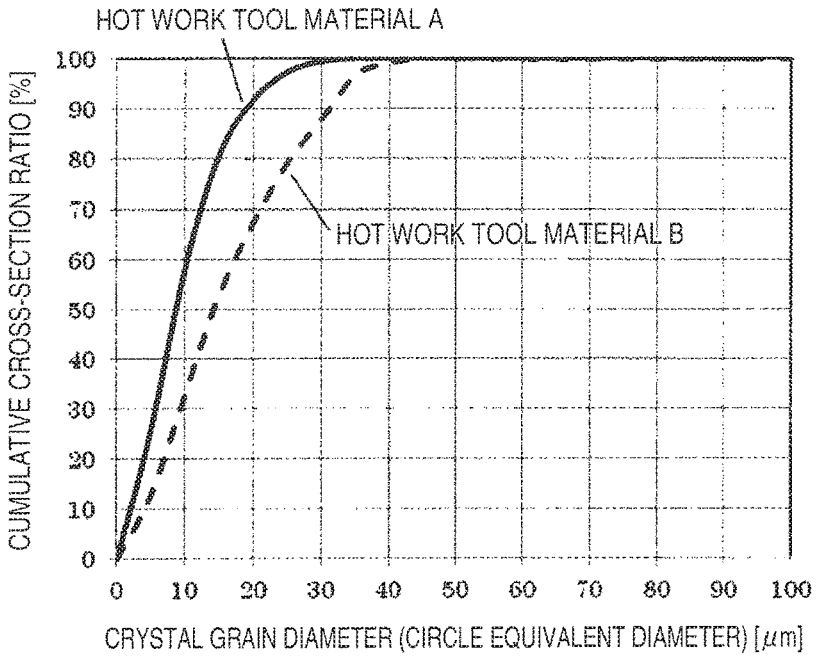
FIG. 3 is a graph showing diameter distributions of ferrite grains of the materials "A" and "B".

Next, a diameter (cross-sectional area) of the individual ferrite grains is determined from the grain boundary view using an image analysis software. The value is converted into a circle equivalent diameter. Then, a grain diameter distribution is produced based on an abundance ratio for the converted circle equivalent diameter of each ferrite grains. In this regard, the abundance ratio is based on a cross-sectional area of the grains. Furthermore, an "oversize" cumulative distribution is employed which takes zero at a small side of the diameter. That is, the grain diameter distribution used for the evaluation in the present invention is expressed as a "steadily increasing cumulative distribution chart" with a vertical axis representing the cumulative cross-sectional area (%) and an abscissa axis representing the circle equivalent diameter of the grains. FIG. 3 is an example of the grain diameter distribution expressed as the oversize cumulative distribution.

After the diameter distribution of the ferrite grains is obtained in the above manner, a circle equivalent diameter when the cumulative cross-sectional area is 90% of the total cross-sectional area (so-called $d_{90}$) is determined from the grain diameter distribution. In the case of FIG. 3, the values of the $d_{90}$ are 19 μm and 31 μm. In the case of the present invention, precipitation sites of the new austenite grains during the heating for quenching are sufficiently abundant and dense when the values of $d_{90}$ are not greater than 25 μm. Then, a fine structure having a prior austenite grain size of, for example, No. 9.0 or more is stably obtained after the quenching and tempering as stated above.

It is desirable that the value $d_{90}$ is smaller for obtaining the effect of refining the structure of the hot work tool of the present invention, and thus there is no need to set a lower limit thereof. However, as a value which is achievable in an actual operation, the lower limit is about 10 μm for example.

The hot work tool material having the annealed structure is typically produced from a raw material of a steel ingot or a billet bloomed from the steel ingot as a starting material, by subjecting it to various hot working or heat treatment, followed by annealing and finishing. The annealed structure of the hot work tool material of the present invention can be achieved, for example, by increasing processing ratio in the hot working (for example, to a processing ratio of 5 or more) and reducing an actual working time of the hot working (for example, within 20 minutes) or reducing a number of re-heating in the course of the hot working (for example, by omitting the reheating), depending on a size of the raw material. Then, the annealing after the hot working can be employ typical conditions at a temperature of not lower than an austenite transformation point or a temperature in a vicinity of the austenite transformation point.

(3) In the method for manufacturing a hot work tool of the present invention, the hot work tool material of the present invention is quenched and tempered.

A prior austenite grain size in a quenched structure after the martensitic transformation can be reduced by quenching the hot work tool material of the present invention. The prior austenite grain size is substantially maintained even after the subsequent tempering. Therefore, when the hot work tool material of the present invention is quenched and tempered, a toughness of the hot work tool can be improved. The toughness is improved to an extent such that, for example, a Charpy impact value of 50 (J/cm$^2$) or more can be stably achieved in a Charpy impact test under conditions of a 2 mm U-notch in an L direction.

The prior austenite grain size may be made, for example, a grain size number of No. 9.0 or more pursuant to JIS-G-0551. The grain size number is preferably No. 9.5 or more. It is more preferably No. 10.0 or more. The grain size number pursuant to JIS-G-0551 is equivalently to the grain size number pursuant to the international standard ASTM-E112.

The prior austenite grains after the quenching and tempering can be observed by the structure after the "quenching" before the tempering. This is because the prior austenite grains are easily observed in in the structure after the quenching since fine tempered carbides do not precipitate. The prior austenite grain size after the quenching is maintained after the tempering.

The hot work tool material of the present invention is produced to have a structure mainly composed of martensite (for example, it includes partially bainite) with a specific hardness by quenching and tempering. It is processed to a product of a hot work tool. In the course, the material is processed to a shape of the tool by various machining such as cutting and drilling. The machining is preferably conducted before the quenching and tempering since the material has a low hardness (that is, in an annealed state). In this case, finish machining may be conducted after the quenching and tempering. However, the machining may be collectively conducted together with the finish machining, in a pre-hardened state after the quenching and tempering, depending on circumstances.

A quenching and tempering temperature differs depending on a composition of the material, or a target hardness, or the like. However, the quenching temperature is preferably around 1000 to 1100° C., and the tempering temperature is preferably around 500 to 650° C. For example, in a case of SKD61, which is a typical steel grade of the hot work tool steel, the quenching temperature is around 1000 to 1030° C., and the tempering temperature is around 550 to 650° C. The quenched and tempered hardness is preferably 50 HRC or less. It is more preferably 48 HRC or less. It is preferably 40 HRC or more. It is more preferably 42 HRC or more.

EXAMPLE 1

Raw materials A and B (50 mm thickness*50 mm width*100 mm length) having a composition shown in Table 1 were prepared. The materials A and B were hot work tool steels of SKD61, which is a standard steel grade of JIS-G-4404. Next, the materials were heated at 1000° C., which is a typical hot working temperature at which a hot work tool steel is hot worked. In this regard, a processing ratio (cross-sectional area ratio) in the hot working of the material A was set to solid forging of 7S, and the processing ratio of the material B was set to solid forging of 3S. Both materials A and B were not reheated during the hot working, and the hot working was completed within an actual time of 5 minutes. The hot worked steel materials were annealed at 860° C., and hot work tool materials A and B were produced (with a hardness of 190 HBW). The hot work tool materials A and B correspond to the raw materials A and B respectively.

TABLE 1

| C | Si | Mn | P | S | Cr | Mo | V | mass % Fe* |
|---|---|---|---|---|---|---|---|---|
| 0.38 | 1.00 | 0.44 | 0.0070 | 0.0030 | 5.23 | 1.21 | 0.88 | Bal. |

*Impurities are included (Cu ≤ 0.25%, Al ≤ 0.040%, Ca ≤ 0.0100%, Mg ≤ 0.0100%, 0 ≤ 0.0100%, N ≤ 0.0300%)

Sectional structures of the annealed hot work tool materials A and B were observed. The observed position is selected at a center of the materials and in a surface parallel to the hot working direction (that is, in a length direction of the materials). The observation was conducted with use of an optical microscope (at a magnification of 200), and the observed cross-sectional area was 0.16 $mm^2$ (400 μm*400 μm). As a result, the sectional structures of the hot work tool materials A and B were almost entirely occupied by a ferrite phase, and 99 area % or more of the observed cross-sections was occupied by the ferrite grains.

Figure 2:
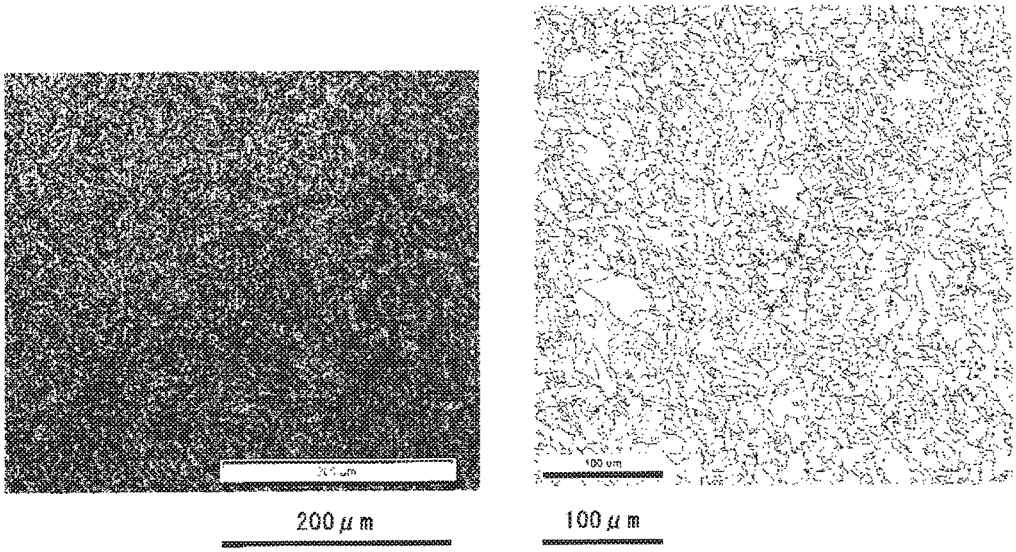
FIG. 2 shows (*a*) an optical microscope image of a sectional structure and (*b*) a grain boundary view obtained by EBSD of a hot work tool material "B" as a comparative Example.

Next, distributions of the ferrite grains in the sectional structures of the hot work tool materials A and B were determined. The cross-sectional area of 0.16 $mm^2$ was analyzed to obtain EBSD pattern at a magnification of 200 and obtain a grain boundary view partitioned by high-angle grain boundaries with an orientation difference of 15° or more. For analyzing the EBSD patterns, an EBSD device (with a measurement interval of 1.0 μm) attached to a scanning electron microscope (Carl Zeiss ULTRA55) was used. The grain boundary view of the hot work tool material A is shown in FIG. 1 (*b*) and that of the hot work tool material B is shown in FIG. 2 (*b*). In FIGS. 1 and 2, optical microscope images (a) are also shown (at a magnification of 200). Then, a diameter (cross-sectional area) of each ferrite grain is obtained from the grain boundary views using an image analysis software as the above manner, and converted into a circle equivalent diameter. Thus, diameter distributions of the ferrite grains based on the circle equivalent diameters were checked.

The grain diameter distributions of the hot work tool materials A and B are shown in FIG. 3. In FIG. 3, a vertical axis represents the cumulative cross-sectional area (%) of the ferrite grains, and an abscissa axis represents the circle equivalent diameter of the ferrite grains. From the results shown in FIG. 3, the circle equivalent diameter when the cumulative cross-sectional area is 90% of the total cross-sectional area ($d_{90}$), of the hot work tool material A was 19 μm, and that of the hot work tool material B was 31 μm.

After the observation of the sectional structures, the materials A and B were quenched at 1030° C. and tempered at 630° C. (with a target hardness of 43 HRC). Thus, the hot work tools A and B having a martensite structure, which correspond to the materials A and B respectively, were obtained. Each of the hot work tools A and B was measured of the prior austenite grain size at a center and in a surface parallel to the hot working direction (that is, the length direction of the material) and evaluated of a grain size number pursuant to JIS-G-0551 (ASTM-E112). As a result, while the hot work tool B had a grain size number of No. 8.0, the hot work tool A had fine grains with a grain size number of No. 10.0. As well, a Charpy impact test (L direction and 2 mm U-notch) was conducted on the hot work tools A and B. As a result, while the tool B had an impact value of 48 J/$cm^2$, the tool A had an impact value of 53 J/$cm^2$, and a toughness was improved. The above results are collectively shown in Table 2.

TABLE 2

| Hot work tool material | Annealed structure Ferrite grain diameter d90 (μm) | Quenched and tempered structure: Prior austenite grain size (JIS number) | Quenched and tempered structure: Charpy impact value (J/$cm^2$) | Remarks |
|---|---|---|---|---|
| A | 19 | 10.0 | 53 | Example according to the invention |
| B | 31 | 8.0 | 48 | Comparative Example |

EXAMPLE 2

Raw materials C and D (50 mm thickness*50 mm width*100 mm length) of hot work tool steels having a composition shown in Table 3 were prepared. Next, the materials were heated at 1000° C. and hot worked. In this regard, the material C was not reheated during the hot working, and the material D was reheated once in the course of the hot working. Then, for both materials C and D, a processing ratio (cross-sectional area ratio) in the hot working was set to solid forging of 7S, and the hot working was completed within an actual time of 5 minutes (except for the reheating time). The hot worked steel materials were annealed at 860° C., and hot work tool materials C and D, which correspond to the raw materials C and D respectively, were produced (with a hardness of 190 HBW).

TABLE 3

| C | Si | Mn | P | S | Cr | Mo | V | mass % Fe* |
|---|---|---|---|---|---|---|---|---|
| 0.36 | 0.36 | 0.62 | 0.0060 | 0.0023 | 4.10 | 2.38 | 0.72 | Bal. |

*Impurities are included (Cu ≤ 0.25%, Al ≤ 0.040%, Ca ≤ 0.0100%, Mg ≤ 0.0100%, 0 ≤ 0.0100%, N ≤ 0.0300%)

Figure 4:
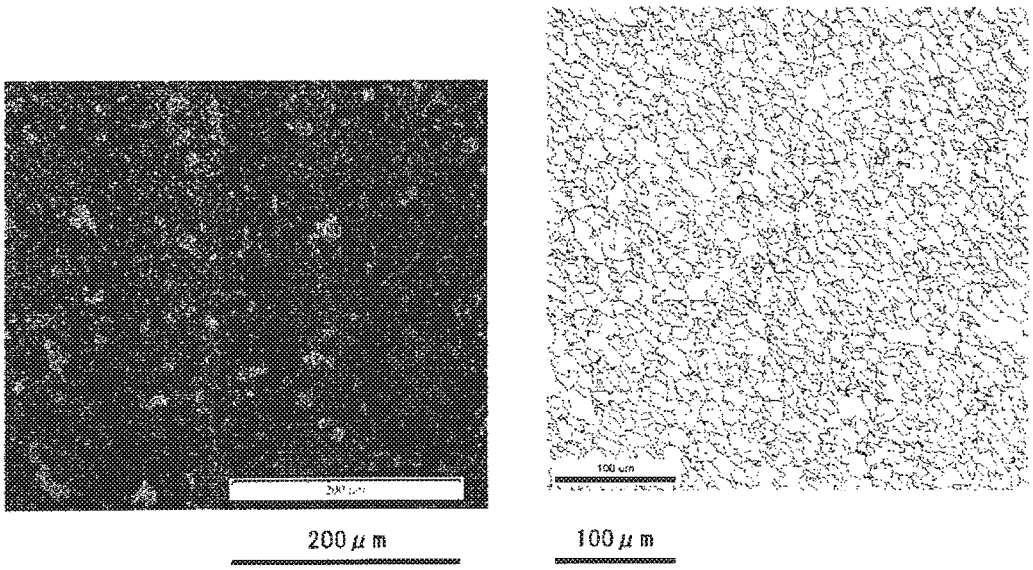
FIG. 4 shows (*a*) an optical microscope image of a sectional structure and a grain boundary view (*b*) obtained by EBSD of a hot work tool material "C" as an example of the invention.
Figure 5:
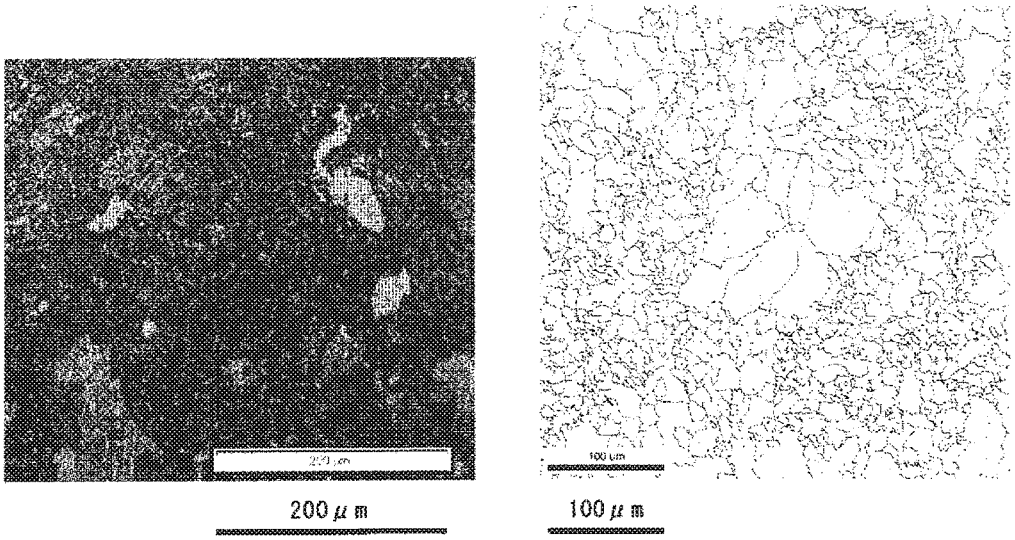
FIG. 5 (*a*) an optical microscope image of a sectional structure and (*b*) a grain boundary view obtained by EBSD of a hot work tool material "D" as a comparative Example.
Figure 6:
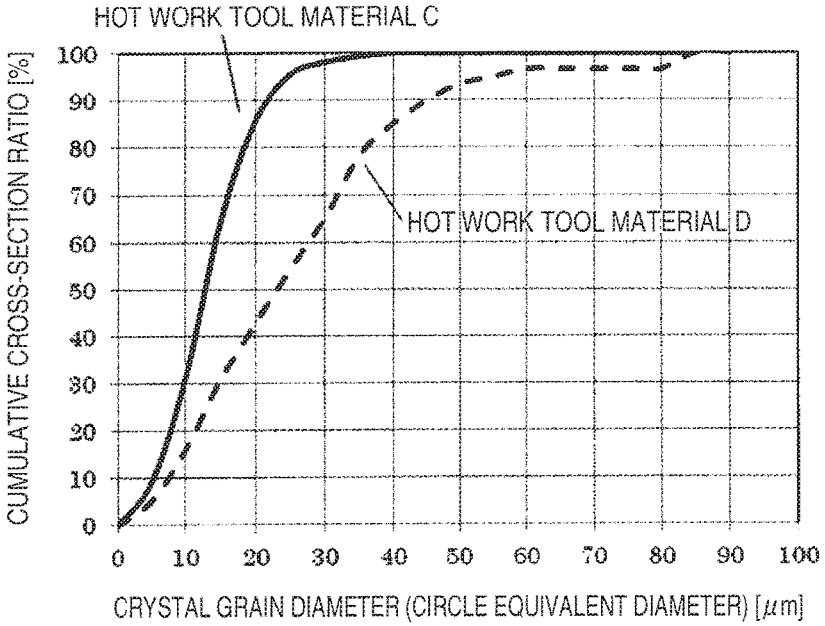
FIG. 6 is a graph showing diameter distributions of ferrite grains in the materials "C" and "D".

Sectional structures of the hot work tool materials C and D were observed in the same manner as in Example 1, and grain boundary views were obtained by the EBSD analyses. The grain boundary view of the hot work tool material C is shown in FIG. 4 (*b*) and that of the hot work tool material D is shown in FIG. 5 (*b*). In FIGS. 4 and 5, optical microscope images (a) are also shown (at a magnification of 200). The sectional structures of the hot work tool materials C and D were almost entirely occupied by a ferrite phase, and 99 area % or more of the observed cross-sections was occupied by the ferrite grains. Diameter distributions of the ferrite grains of the hot work tool materials C and D are shown in FIG. 6. From the results shown in FIG. 6, the circle equivalent diameter, when the cumulative cross-sectional area is 90% of the total cross-sectional area ($d_{90}$), of the hot work tool material C was 22 μm, and that of the hot work tool material D was 44 μm.

After the observation of the sectional structures, the materials C and D were quenched at 1030° C. and tempered at 650° C. (with a target hardness of 43 HRC). Thus, hot work tools C and D having a martensite structure, which correspond to the hot work tool materials C and D respectively, were obtained. Each of the hot work tools C and D was measured of prior austenite grain size at a center and in a surface parallel to the hot working direction (that is, the length direction of the material) and evaluated by a grain size number pursuant to JIS-G-0551 (ASTM-E112). As a result, while the hot work tool D had a grain size number of No. 6.5, the hot work tool C had fine grains with a grain size number of No. 10.0. As well, a Charpy impact test (L direction and 2 mm U-notch) was conducted on the hot work tools C and D. As a result, while the tool D had an impact value of 47 J/cm$^2$, the tool C had an impact value of 51 J/cm$^2$, and a toughness was improved. The above results are collectively shown in Table 4.

TABLE 4

| Hot work tool material | Annealed structure Ferrite grain diameter d90 (μm) | Quenched and tempered structure: Prior austenite grain size (JIS number) | Quenched and tempered structure: Charpy impact value (J/cm$^2$) | Remarks |
|---|---|---|---|---|
| C | 22 | 10.0 | 51 | Example according to the invention |
| D | 44 | 6.5 | 47 | Comparative Example |

The invention claimed is:

1. A hot work tool material having an annealed structure and a composition consisting of, by mass %:

C: 0.30% to 0.50%,

Si: not greater than 2.00%,

Mn: not greater than 1.50%,

P: not greater than 0.0500%,

S: not greater than 0.0500%,

Cr: 3.00% to 6.00%, one or both of Mo and W in an expression of (Mo+½ W): 0.50% to 3.50%, V: 0.10% to 1.50%, Ni: 0% to 1.00%, Co: 0% to 1.00%, Nb: 0% to 0.30%, and the balance of Fe and impurities, wherein the annealed structure comprises ferrite grains in a cross-sectional structure, the ferrite grains having, in an oversize cumulative distribution based on a cross-sectional area of the ferrite grains, a grain diameter distribution such that the grain diameter is not greater than 25 μm as a circle equivalent diameter when the cumulative cross-sectional area is 90% of the total cross-sectional area.

2. A method for manufacturing a hot work tool, comprising quenching and tempering the hot work tool material according to claim 1.

3. The method according to claim 2, wherein a prior austenite grain size number in the structure of the hot work tool after the quenching and tempering is not less than No. 9 as a grain size number pursuant to JIS-G-0551.

* * * * *